United States Patent [19]

Price

[11] 4,285,081

[45] Aug. 25, 1981

[54] DEVICE FOR RECUMBENCY OF THE HEAD AND NECK

[76] Inventor: George W. E. Price, 4 Longfellow Pl., 0608, Boston, Mass. 02114

[21] Appl. No.: 86,652

[22] Filed: Oct. 22, 1979

[51] Int. Cl.[3] ..... A47G 9/00

[52] U.S. Cl. ..... 5/434; 5/439; 297/391; 297/393

[58] Field of Search ..... 5/431, 434, 436–439, 5/441; 297/391, 393

[56] References Cited

U.S. PATENT DOCUMENTS

| | | | |
|---|---|---|---|
| 394,044 | 12/1888 | Widmayer | 297/391 |
| 2,803,834 | 8/1957 | McClung | 297/391 |
| 3,017,221 | 1/1962 | Emery | 5/437 |
| 3,283,344 | 11/1966 | Blanchard | 297/393 |
| 3,296,634 | 1/1967 | Rusnak | 5/437 |
| 3,753,264 | 8/1973 | Grenier | 297/391 |

*Primary Examiner*—Casmir A. Nunberg
*Attorney, Agent, or Firm*—Bruce D. Sunstein

[57] ABSTRACT

A portable device for recumbency of the head and neck providing support for the same while travelling or in other situations where discomfort arises from lack of adequate support. The device is provided with a surface having a generally concave shape with respect to a vertical axis of curvature corresponding approximately to the central vertebral axis of the neck. The concave shape is fashioned so that it has symmetrical left and right halves, opposing areas of which are designed to exert gentle pressure in the vicinity of the mastoid processes of the head, a region near the base of the head, and located at the sides thereof almost at the rear. There are two embodiments of the device, one a padded resilient sheet curved to provide the support surface and a second in the form of an inflatable pillow.

9 Claims, 14 Drawing Figures

DEVICE FOR RECUMBENCY OF THE HEAD AND NECK

DESCRIPTION

1. Technical Field

The present invention relates generally to devices for the support of the head and neck, such as certain pillows and head rests.

2. Background Art

Pillows of a generally rectangular shape are used often not merely in making the head and neck comfortable when reclining but also when seated in an upright or semi-upright position, as for example, when engaged in vehicular travel. In attempts to alleviate discomfort experienced by use of conventional pillows in these circumstances, various supports and pillows have been devised and are known in the prior art.

For example, U.S. Pat. No. 673,872 discloses an annular roll-shaped air cushion arranged to fit around the neck. U.S. Pat. No. 4,031,578 discloses a travel pillow that includes a pair of side cushions linked by a back spacer in such a way as to envelope the head from the base of the neck above the ears when one's head and neck are recumbent therein. Other configurations of pillows and head rests are disclosed, for example, in U.S. Pat. Nos. 2,589,155, 98,859, and 247,823.

These devices have afforded some improvement over a conventional pillow. Nevertheless, none of these devices have afforded the comfort that is possible when the head and neck are given improved support. Moreover, the bulk of many of the prior art embodiments makes them unsuited for portable use.

DISCLOSURE OF INVENTION

It is an object of the present invention to provide a novel device for recumbency of the head and neck.

It is also an object of the present invention to provide a portable device for recumbency of the head and neck for use in travelling and in other situations where a source of discomfort arises from lack of adequate support of the head and neck.

It is a further object of the present invention to provide a device for giving good support to the head and neck.

These and other objects of the invention are achieved by providing a device with a surface having a generally concave shape with respect to a vertical axis of curvature corresponding approximately to the central vertebral axis of the neck; the concave shape is fashioned so that it has symmetrical left and right halves, opposing areas of which are designed to exert gentle pressure in the vicinity of the mastoid processes of the head, a region near the base of the head, and located at the sides thereof almost at the rear.

BRIEF DESCRIPTION OF THE DRAWINGS

These and other objects and features of the invention will be more readily understood by consideration of the following detailed description taken with the accompanying drawings, in which.

DESCRIPTION OF THE SPECIFIC EMBODIMENTS

Figure 1:
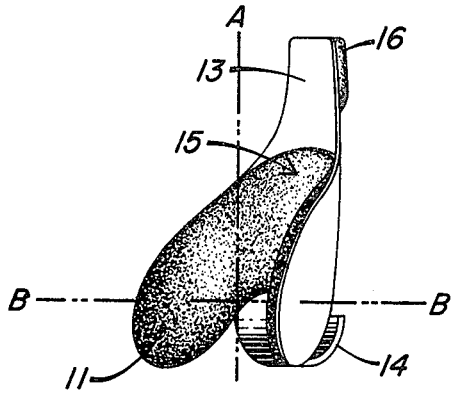
FIGS. 1 through 6 relate to a particular embodiment of the invention, showing respectively perspective, top, front, bottom, rear, and side views of the embodiment.

Referring now to FIG. 1, there is shown a perspective view of a preferred embodiment of the device. It is oriented as if to be used by a person sitting upright. The line AA indicates the central vertebral axis of the neck of the user. Line AA also indicates a vertical axis of curvature of the device, as will be explained more fully with respect to FIGS. 2 through 6, and particularly FIG. 4. In FIG. 1, however, it can be seen that the device has a curved shape with respect to the axis AA, and it has bilateral symmetry. The left half of the concave shape is shown as item 11. It is shown as having a padded inner surface and in use this surface exerts gentle pressure in the vicinity of the mastoid process of the head.

Still referring to FIG. 1, there is also shown horizontal axis BB. This axis intersects the vertical axis AA. As will be more particularly discussed with respect to FIG. 6, the device has a surface that is also convex in relation to this axis. The convex aspects of the surface permit the use of the device in such a way that the area shown as 15 in FIG. 1 conforms generally to the lower portion of the occipital bone of the head. Item 13 of the device is an upward extension of the basic dually curved surface and is formed so as to receive comfortably the region at the back of the head above the lower portion of the occipital bone. Also, shown in FIG. 1 is the curved lower extension 14 of the device. The curved lower extension is shaped in such a way as to give the device a springing engagement against the generally vertical surface against which the device is resting. The springing action gives the user an experience similar to that given by a pillow but in a fashion without requiring an elaborate stuffed, filled, or inflated device. This springing action is enhanced by presence of the rear pad 16 on the rear of the upward extension 13. The rear pad 16 serves as a resilient spacer between the rear of the upward extension 13 and the surface against which the device is resting. Thus both the upper and lower portions of the device rest in springing engagement against the surface.

Figure 2:
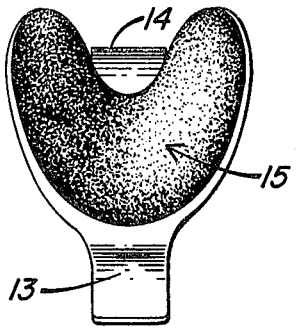

Referring to FIG. 2, there is shown a top view of the device. Throughout the description of the device, item numbers are used uniformly, so that the number used in one figure to identify a feature of the device will identify the same feature of the device in any subsequent figure. As a result, shown in FIG. 2 are the upward extension 13, the area 15 that conforms to the lower portion of the occipital bone, and the lower extension 14.

Figure 3:
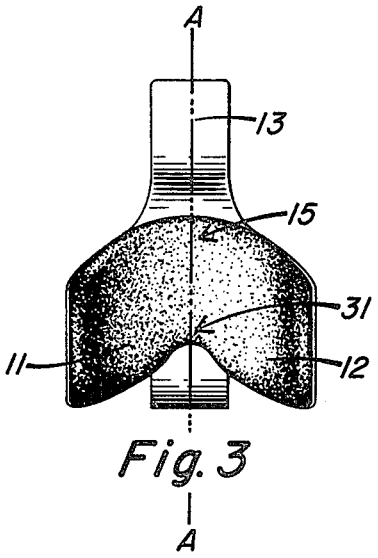

FIG. 3 is a front view of the same embodiment. The left half 11 and the right half 12 of the concave shape are shown clearly. Also shown for the first time is the area 31 for receiving the upper portion of the nape of the neck. It can be seen that the embodiment has bilateral symmetry with respect to a plane perpendicular to the page passing through axis AA.

Figure 4:
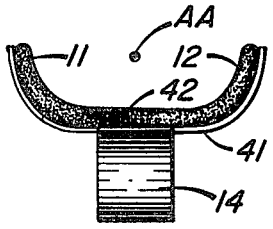

In FIG. 4 the curvature about axis AA is shown clearly. In this bottom axis of the embodiment, it can be seen that the curvature is produced by plastic sheet 41. The sheet is padded with a single foam layer 42 in the interior region of the sheet, so as to make more comfortable the use of the device.

Figure 5:
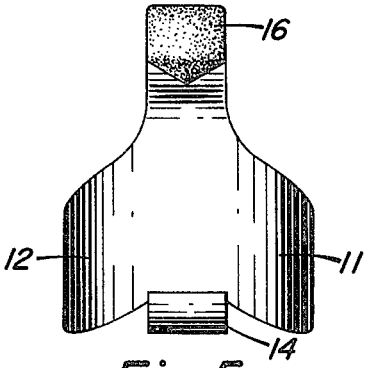

Referring now to FIG. 5, there is shown a rear view of the device. The rear pad 16 is evident. The lower extension 14 is shown curving behind the device and toward the reader, as will be more clearly indicated by FIG. 6.

Figure 6:
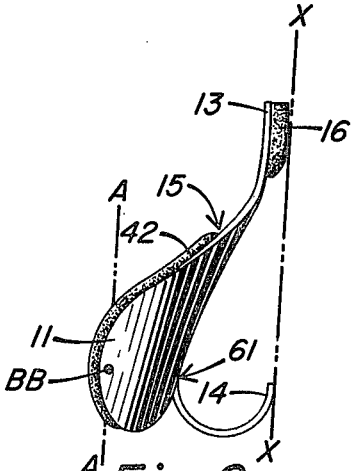

In FIG. 6, which is a side view of this embodiment, the axis AA is shown in fore-aft relation to the device. In use, the device rests against a surface represented by line XX. The device is thus supported by (a) the rear pad 16, (which in turn supports the upward extension 13) and (b) the lower extension 14. With respect to horizontal axis BB, shown in profile in FIG. 6, the device has a convex curvature. The region of this convex curvature, indicated generally as item 61, corresponds with area 31, shown in FIG. 3, where the device is shaped to conform to the upper portion of the nape of the neck. An examination of FIG. 6 will reveal that the device is shaped so as to permit the central vertibral axis AA of the neck to be approximately parallel to the plane of the resting surface indicated by XX.

Figure 7:
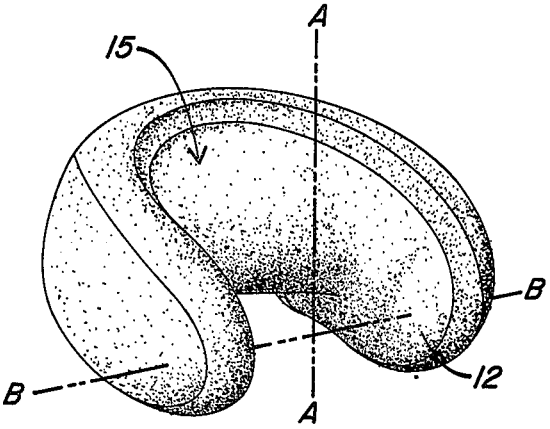
FIGS. 7 through 12 relate to another embodiment of the invention, showing respectively perspective, bottom, front, top, back, and side views of the embodiment.
Figure 9:
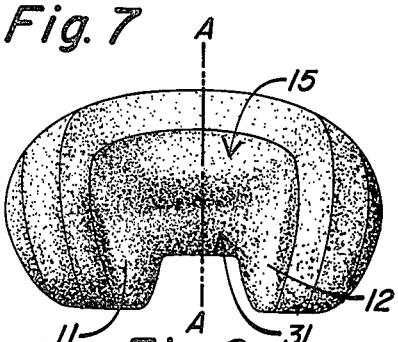
Figure 8:
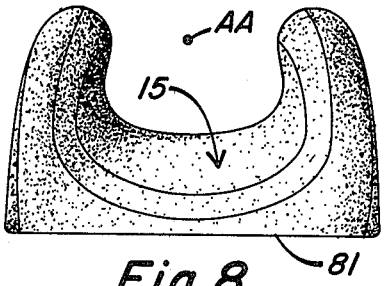

Referring to FIG. 7, another preferred embodiment of the invention is illustrated. In this embodiment, the support-giving shape of the invention is created by making an inflatable pillow. Although this embodiment is shown as inflatable, a similar form could be created using a suitable stuffing material. In the embodiment shown in FIG. 7, upward extension 13 the lower extension 14 are not necessary, because the embodiment can rest comfortably against a surface without these items. Item 15, shown in FIG. 7, thus is both the area wherein the lower occipital bone can rest and the upper region of the embodiment. Shown in FIG. 7 is also the dual curvature of the surface of the invention. There is concave curvature with respect to the vertebral axis AA of the neck and convex with respect to horizontal axis BB that intersects axis AA. A top view of this embodiment is shown in FIG. 8. Again, curvature about axis AA is shown clearly. Also illustrated in profile is back 81, which is generally flat, and permits the device to be used without the upward and lower extension 13 and 14 illustrated with respect to the embodiment shown in FIG. 1. FIG. 9 is a front view of the same embodiment shown in FIG. 7, and the bilateral symmetry with respect to a plane rising vertically from the page and passing through axis AA is shown.

Figure 10:
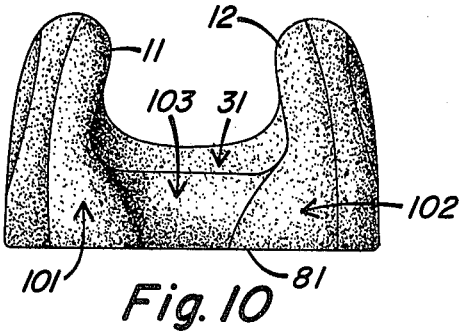

FIG. 10 is a bottom view of this embodiment. Area 31 conforms to the upper portion of the nape of the neck. This embodiment is designed so that curving away from area 31 is a region 103 to permit the embodiment to be used without interfering with the lower region of the neck, although it can offer some support in this region. The consequence of the creation of area 103 is to have small contours 101 and 102 on each side of area 103.

Figure 11:
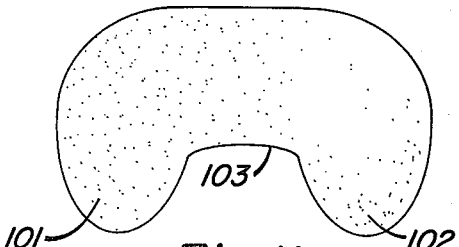

FIG. 11 is a back view. Profiles of the contours 101 and 102 as well as of the area 103 are illustrated.

Figure 12:
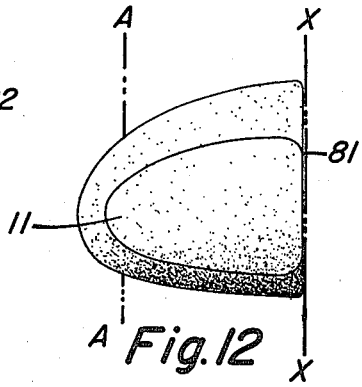

In the side view offered by FIG. 12, the flat back 81 is shown resting on a flat surface the plane of which is shown in profile as line XX. The vertebral axis of the neck is shown again as AA.

Figure 13:
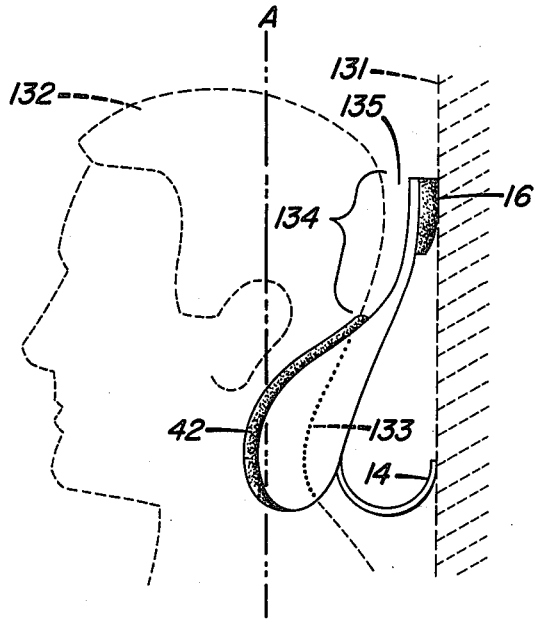
FIGS. 13 and 14 show in use respectively the embodiments shown in FIGS. 1 through 6 and FIGS. 7 through 12.
Figure 14:
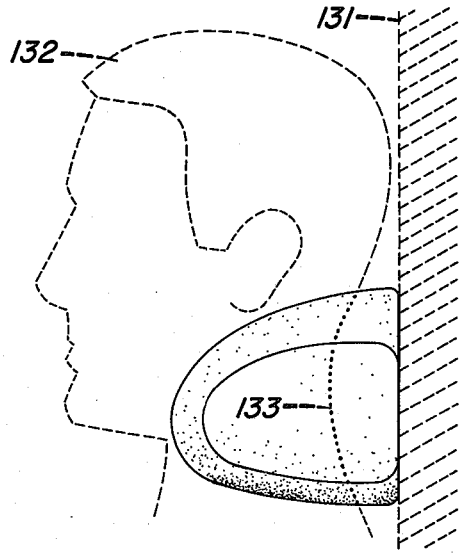

FIGS. 13 and 14 show in use the embodiments shown in FIGS 1-6 and FIGS. 7-12 respectively. In FIG. 13, the embodiment is shown in side perspective resting against a surface 131. Surface 131 could be, for example, the surface of the back of a chair in which the user, whose head 132 is illustrated, is sitting. Although these illustrations have been made with respect to an implied position of the user that is approximately erect, use is in no way limited to such a position and the invention has been found useful, for example, in the prone position and in reclining positions. Because the device is in use, the curved lower extension 14 and the rear pad 16 are somewhat deformed as a result of the pressure of the head against the device; this pressure is transmitted to the surface 131 via rear pad 16 and curved lower extension 14. The profile of the portions of the rear of the head and neck resting in the device are shown as the dotted line 133. Substantially the entire force exerted by the head against the surface 131 is transmitted along the region indicated by dotted line 133; that is, the upper part of the head, indicated by the bracketed region 134, does not exert substantial force against the device. In fact, in the embodiment shown, there is a gap 135 between the rear of the upper portion of the head and the device. It is possible to provide support in this unsupported region, but a feature of the present invention is that much support is not necessary for proper functioning of the device. Many, if not most, humans have a carriage that places the rearmost portion of the occipital protuberance in a plane somewhat forward of the plane (referred to below as the "scapulae plane"), generally parallel to the vertebral axis of the neck in which lies the rearmost portion of the scapulae. This trait is more evident among many elderly persons who have what is commonly referred to as "dowager's hump". Moreover, the natural curve of the neck shown as dotted line 133 is well known. The present invention has been conceived in part to provide a support for holding the region 133 in a comfortable relation to the scapulae plane when the user is seated, reclining, or prone. If the dimensions of the lower extension 14 are not suitably chosen and if the thickness of pad 16 is excessive, the head 132 will be thrown too far forward and out of its natural relation to the scapulae plane and the user may experience discomfort. On the other hand, when these dimensions are suitably chosen, the invention can afford great comfort to the user.

The embodiment shown in FIG. 14 operates on precisely the same principles as that shown in FIG. 13, except that resistance is provided in the FIG. 14 embodiment by the air cushion within rather than by specific appendages as in the case of the FIG. 13 embodiment.

Accordingly, while the invention has been described with particular reference to specific embodiments thereof in the interest of complete definiteness, it will be understood that it may be embodied in a variety of forms diverse from those shown and described without departing from the spirit and scope of the invention defined by the following claims.

What is claimed is:

1. A device for recumbency of the head and neck, such device comprising a supporting surface having a generally concave shape with respect to a vertical axis of curvature that corresponds approximately to the central vertebral axis of the neck so that (a) the generally concave shape has left and right halves that are symmetrical about the line of their junction and also so that (b) symmetrically opposed areas in the vicinity of non-adjacent edges of each half exert gentle pressure in the vicinity of the mastoid processes of the head, wherein the surface also has a generally convex shape with respect to a horizontal axis, such axis intersecting the vertical axis of curvature, so that the generally convex shape conforms generally to at least the upper portion of the nape of the neck and the lower portion of the occipital bone of the head.

2. The device of claim 1, further comprising an inflatable volume, which when inflated has the previously described surface.

3. The device of clam 1, further comprising a stuffed pillow which has the previously described surface.

4. The device of claim 1, further comprising a sheet of material having a generally concave shape with respect to a vertical axis of curvature that corresponds to the central vertebral axis of the neck so that (a) the generally concave shape has left and right halves that are symmetrical about the line of their junction and also so that (b) symmetrically opposed areas in the vicinity of non-adjacent edges of each half exert gentle pressure in the vicinity of the mastoid processes of the head, wherein the sheet of material also has a generally convex shape with respect to a horizontal axis, such axis intersecting the vertical axis of curvature, so that the generally convex shape conforms generally to at least the upper portion of the nape of the neck and the lower portion of the occipital bone of the head, wherein the surface of such material facing the vertical axis of curvature is hereinafter referred to as the "inside" and the surface of such material facing away from the vertical axis of curvature is hereinafter referred to as the "outside".

5. The device of claim 4, further comprising padding on at least a portion of the inside of the sheet.

6. The device of claim 4, further comprising an upward extension of the surface from the generally convex shape, in a direction generally parallel to the vertical axis; and first means, affixed to the device proximate to the lower portion of the convex shape, for causing the shape to press gently against the nape of the neck and lower portion of the occipital bone when the outside of the upward extension is placed against a vertical surface.

7. The device of claim 6, wherein the first means comprises a resilient material so as to permit engagement of the convex shape yieldingly against the nape of the neck and lower portion of the occipital bone.

8. The device of claim 7, wherein the material is resilient and first means is formed as part of the sheet of material.

9. The device of claim 8, wherein the first means comprises a curved extension of the generally concave shape, such extension beginning in a generally downward direction and forming an arc in excess of 180°.

* * * * *